US005655573A

United States Patent [19]

Gheysen et al.

[11] Patent Number: 5,655,573

[45] Date of Patent: Aug. 12, 1997

[54] METHOD FOR MANUFACTURING A FACE-TO-FACE PILE FABRIC HAVING WEFT THREADS LOCATED ABOVE ONE ANOTHER

[75] Inventors: Nico Gheysen, Sint-Eloois-Winkel; André Dewispelaere, Marke; Jos Mertens, Kortrijk, all of Belgium

[73] Assignee: N.V. Michael Van de Wiele, Kortrijk/Marke, Belgium

[21] Appl. No.: 257,896

[22] Filed: Jun. 10, 1994

[30] Foreign Application Priority Data

| | | | |
|---|---|---|---|
| Jun. 11, 1993 | [BE] | Belgium | 09300593 |
| Jul. 16, 1993 | [BE] | Belgium | 09300747 |
| Jan. 10, 1994 | [BE] | Belgium | 09400024 |
| Mar. 11, 1994 | [BE] | Belgium | 09400272 |
| May 2, 1994 | [BE] | Belgium | 09400450 |

[51] Int. Cl.[6] ..... D03D 27/10

[52] U.S. Cl. ..... 139/21; 139/398

[58] Field of Search ..... 139/21, 398

[56] References Cited

U.S. PATENT DOCUMENTS

| | | | |
|---|---|---|---|
| 4,756,340 | 7/1988 | Janssen | 139/398 X |
| 4,971,642 | 11/1990 | Schwan . | |
| 5,398,730 | 3/1995 | Derudder et al. | 139/21 |
| 5,400,831 | 3/1995 | Gheysen | 139/21 |

FOREIGN PATENT DOCUMENTS

| | | |
|---|---|---|
| 320715 | 7/1989 | European Pat. Off. . |
| 624660 | 6/1927 | France . |
| 40907 | 9/1932 | France . |
| 2182790 | 12/1973 | France . |
| 630133 | 10/1932 | Germany . |
| 2164948 | 7/1973 | Germany . |
| 4221376 | 1/1994 | Germany . |
| 1400297 | 7/1975 | United Kingdom . |

*Primary Examiner*—Andy Falik

*Attorney, Agent, or Firm*—James Creighton Wray

[57] ABSTRACT

A method for manufacturing a face-to-face pile fabric wherein first weft thread is provided in the top fabric and the bottom fabric adjacent to second and third weft threads located one above another. Three weft threads are inserted simultaneously. Each warp thread system, has binder warp threads, tension warp threads and pile-forming pile warp threads interlacing with a three-pick weave. In each case pile is formed on the first weft thread provided on the back of the second and the third weft thread. Binding of the dead pile warp thread is distributed over both the fabrics. Pile is formed on the third weft thread located on a back side. A pile thread that starts forming a pile or finishes forming a pile is first interlaced with a third weft thread before is starts forking the pile or before it is bound-in. Binder warp threads are provided to bind the first weft threads in a separate opening. Pile is formed on the first weft thread which is not provided on the back of the fabrics. Each warp thread system has two tension warp threads.

21 Claims, 8 Drawing Sheets

FIG. 1
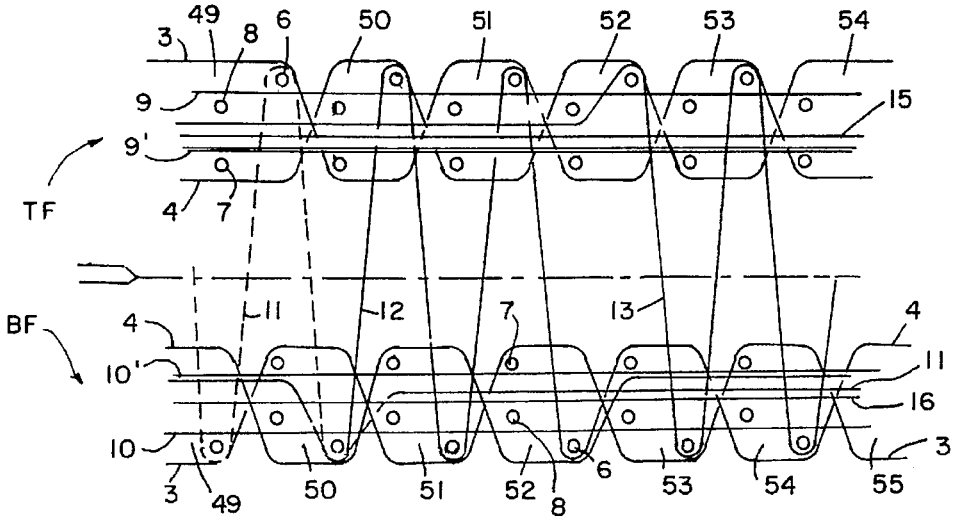
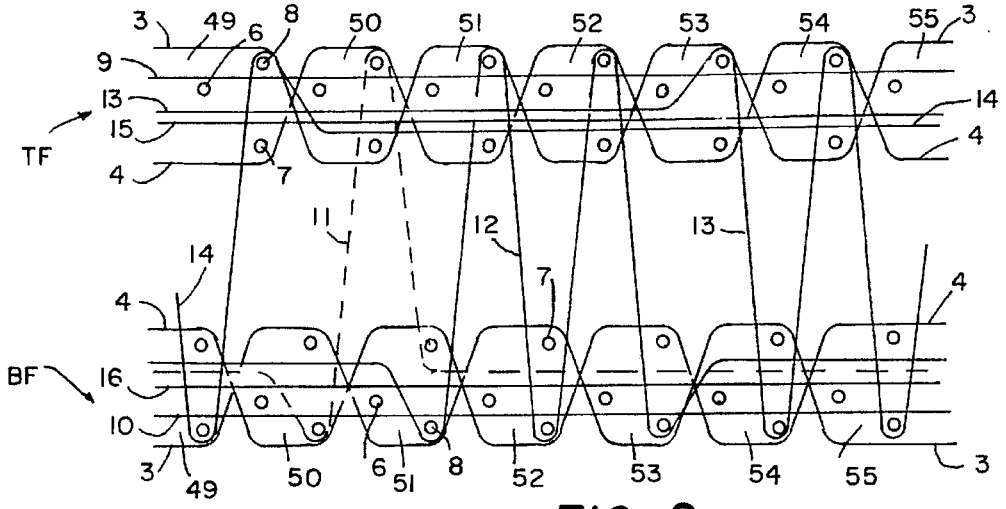
FIG. 2
FIG. 3
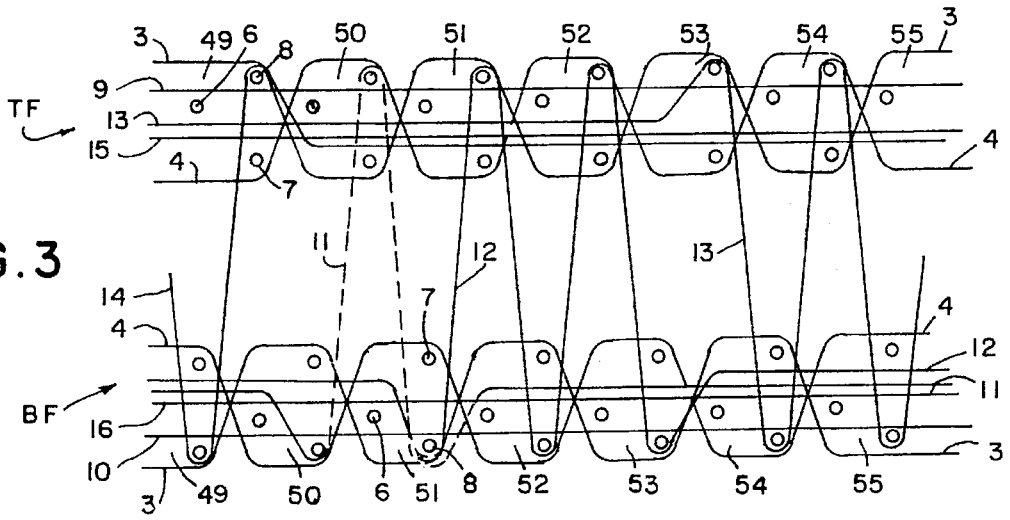

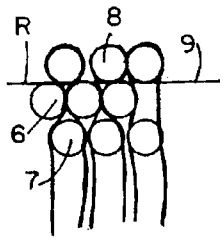
FIG. 4
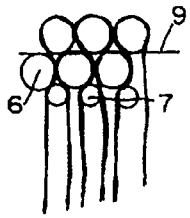
FIG. 5
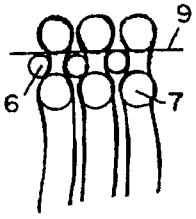
FIG. 6
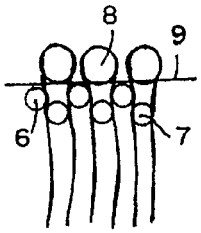
FIG. 7
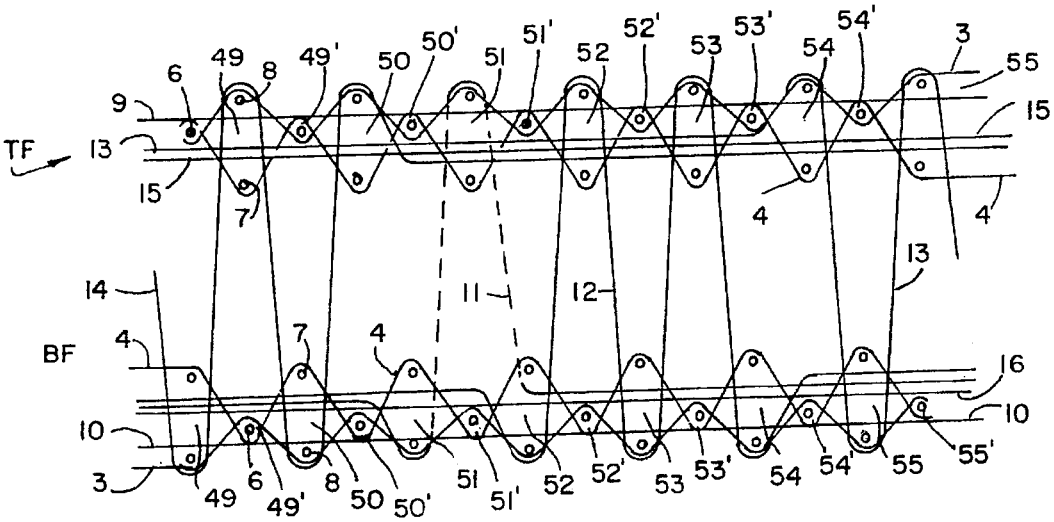
FIG. 8
FIG. 9
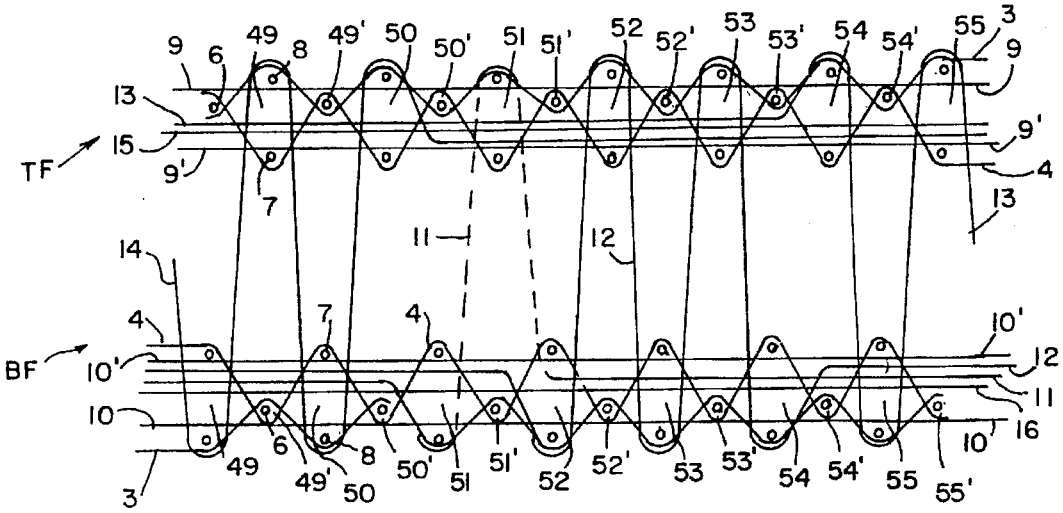

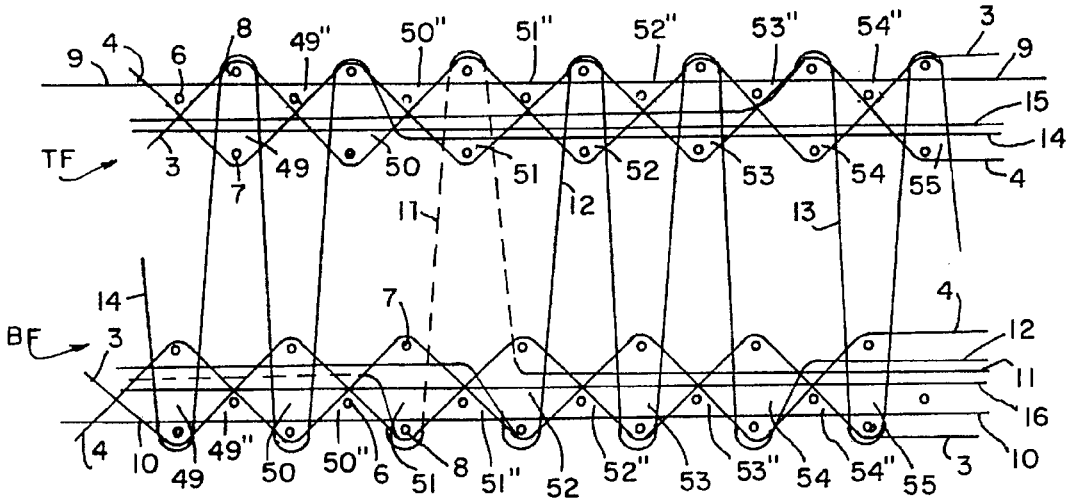
FIG. 10
FIG. 11
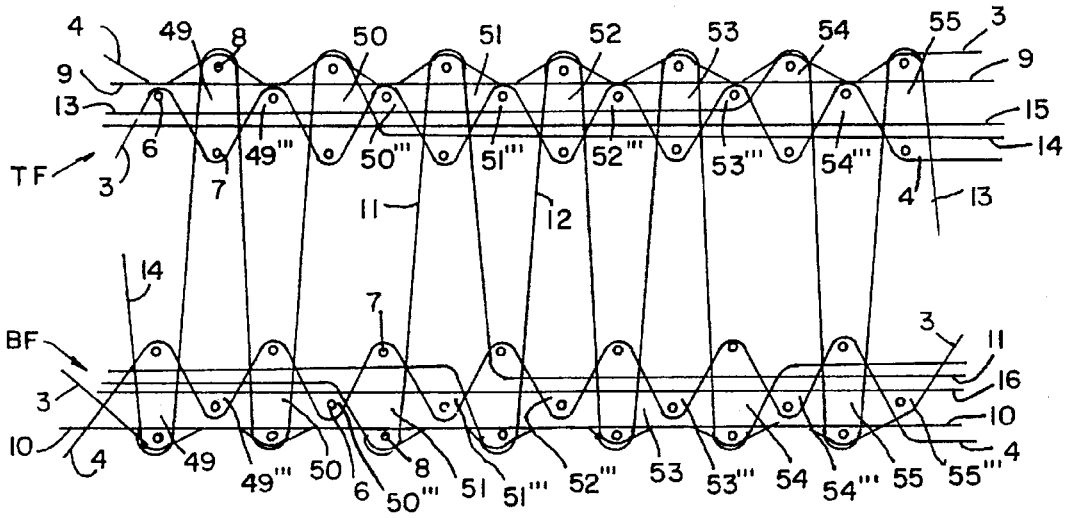
FIG. 12
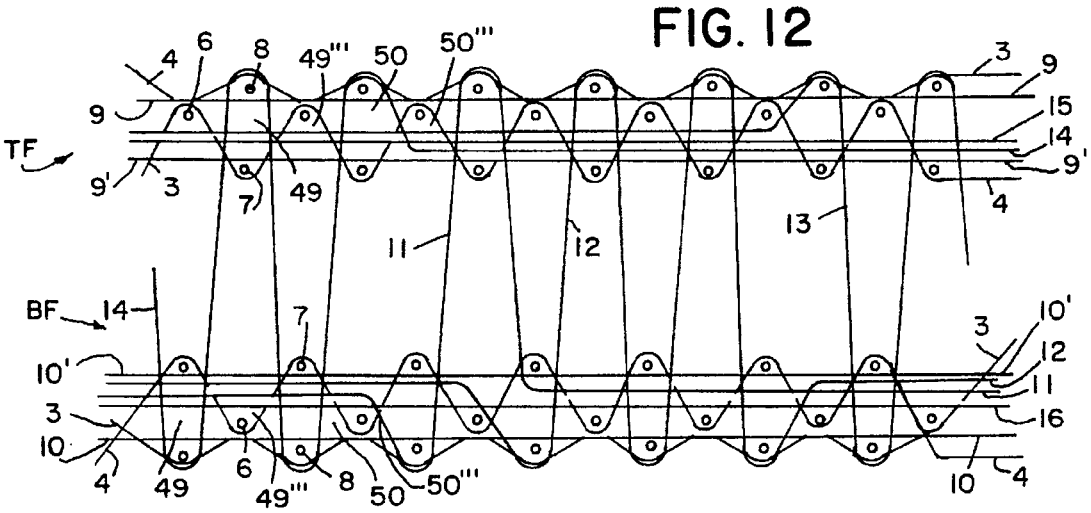

FIG. 24
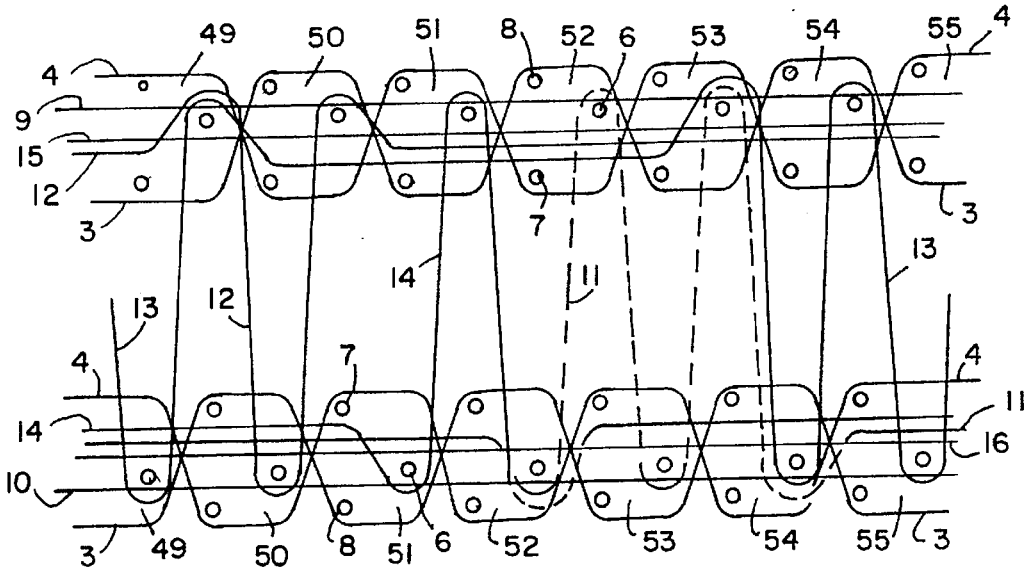
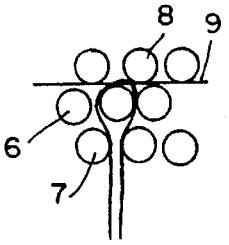
FIG. 25
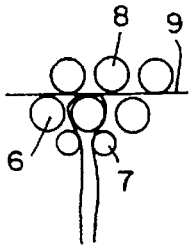
FIG. 26
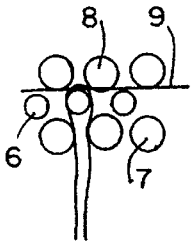
FIG. 27
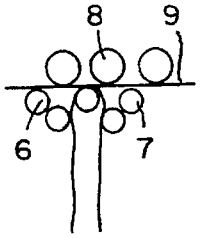
FIG. 28

METHOD FOR MANUFACTURING A FACE-TO-FACE PILE FABRIC HAVING WEFT THREADS LOCATED ABOVE ONE ANOTHER

BACKGROUND OF THE INVENTION

1. Field of Invention

The present invention relates to a method for manufacturing a face-to-face pile fabric, in which a top fabric and a bottom fabric are formed by providing successive groups of three weft threads for each fabric, so that, in every group, a first weft thread extends next to a second and a third weft thread, which are located one above the other, by providing, for each fabric, adjacent warp thread systems having two binder warp threads which cross a number of times so as to form successive openings between their points of intersection, through which extends in each case a group of weft threads, and by binding a tension warp thread into each fabric in each of the warp thread systems;

in each case three weft threads are inserted simultaneously;

in accordance with a three-pick weave, in each of the warp thread systems at least one pile-forming pile warp thread is interlaced with a weft thread, alternately in the top fabric and in the bottom fabric;

and all pile-forming pile warp threads between both fabrics are cut through in order to obtain two separate pile fabrics.

2. Prior Art

Such a method is known from FR-2.182.790.

According to this known method, the pile-forming pile warp threads are in each case interlaced with the third weft threads located on the back of the fabrics (except in case of a change of pile).

In each case, two weft threads are inserted simultaneously into one fabric and one weft thread into the other fabric, a weaving loom thus inserting six weft threads in two working cycles.

According to this method, the dead pile warp threads (i.e. the pile warp threads or parts of pile warp threads which do not form pile) are alternately bound into the top fabric and into the bottom fabric in the successive warp thread portees (a warp thread portee consists of a warp thread system of the top fabric and a warp thread system of the bottom fabric, whose binder warp threads, tension warp threads and pile warp threads are located one above the other).

After the face-to-face fabric has been cut through, each fabric comprises successive rows of pile loops which have been interlaced with corresponding weft threads. These pile loops have upright pile sides. In order to achieve perfect pile formation, these pile sides have to extend at right angles to the plane of the backing fabric (which comprises weft threads, binder warp threads and tension warp threads). If this is not the case (i.e. with a so-called drawn pile), a fabric of inferior quality is obtained. As a result of a drawn pile, mixing contours may occur in the fabrics.

If the pile sides form different colour fields in a pile fabric (in order to produce a design or pattern), mixing contours occur when pile sides of a different color are visible among pile sides of one color on the pile surface of the fabrics. This is caused as a result of pile sides of one color extending at an angle among the pile sides of another color in the vicinity of the separation line between two color fields, and being visible at the pile surface of the fabric.

The colors mix and the fabrics have no clearly defined separation line between adjacent color fields.

The fabric produced according to the method of FR-2.182.790 exhibits a drawn pile.

SUMMARY OF THE INVENTION

It is an object of this invention, to provide a method for manufacturing a face-to-face pile fabric by means of which a drawn pile is prevented while binding in the dead pile warp threads in each warp thread portee distributed over both fabrics.

It was found that the drawn pile was a result of the fact that the first weft threads penetrate the second and third weft threads lying above one another. The upright sides of the pile loops therefore tend to spread out, thereby not remaining in the desired upright position as the face-to-face pile fabric is cut through.

The abovementioned object is achieved according to this invention in that the first weft threads of successive groups extend in a first plane, which lies on the back relative to a second and third plane in which, respectively, the second and third weft threads of these successive groups extend, because the pile-forming pile warp threads are in each case interlaced with a first weft thread, and because the dead pile warp threads are bound in in each Warp thread portee, distributed over both fabrics.

Thus, two weft threads (the second and third weft threads), one above the other, are located in each case on either side of a pile loop. These weft threads keep the pile sides upright. In addition, the first weft thread is prevented from penetrating the second and third weft threads located above one another.

As a result, the pile sides remain in the desired position after the face-to-face pile fabric is cut through, at right angles to the plane of the backing fabric, so that a drawn pile no longer occurs.

Furthermore, the quality of the fabrics is also improved as the dead pile warp threads are bound in in each warp thread portee distributed over both fabrics.

With the known method according to FR-2.182.790, the pile warp threads which finish forming pile are interlaced with a second weft thread in a first warp thread portee before they are bound into the top fabric, and the pile warp threads which start forming pile are interlaced with a third weft thread before they start to form pile (run to the bottom fabric).

In a subsequent warp thread portee, the pile warp threads which finish forming pile are interlaced with a third weft thread before they are bound into the bottom fabric, and the pile warp threads which start forming pile are interlaced with a second weft thread before they start forming pile (run to the top fabric).

The face-to-face pile fabric has alternating first and second warp thread portees.

In each fabric, there are thus pile warp threads which interlace with second weft threads (located on the side of the pile).

The pile sides thus formed are not visible on the back of the fabrics. The pattern of the pile fabrics is thus not completely visible on the back of the fabrics. Moreover, the visible part of the pattern appears as a dashed line.

An additional object of this invention is to produce the complete pattern of the pile fabrics clearly on the back of the fabrics.

If, in the known method, the dead pile warp threads were to be bound in distributed over both fabrics, this would lead to mixing contours. When a first pile warp thread which was bound into one fabric starts forming pile (runs to the other fabric) and a second pile warp thread which was forming pile runs to said other fabric in order to be bound into the latter, both pile warp threads jointly run between both fabrics. This causes mixing contours after the face-to-face pile fabric is cut through.

In order to prevent mixing contours, it should be ensured that, with the pile warp threads which have a pile-forming part which changes into a bound-in part and/or a bound-in part that changes into a pile-forming part, a last or a first pile side, respectively, of said pile warp threads remains upright relative to the backing fabric after the fabrics have been cut through.

Mixing contours are prevented and the complete pattern of the pile fabrics appears clearly on the back by means of interlacing a pile warp thread with a first weft thread, before said pile warp thread is bound in or starts forming pile, respectively.

In this manner, said first and last pile sides are also laterally supported by weft threads located one above the other, after the face-to-face pile fabric has been cut through. The pile sides remain upright, thereby preventing mixing contours. Moreover, each pile side is interlaced with a weft thread on the back, so that the pattern is clearly and completely visible on the back of the fabrics.

With a method as described in the first paragraph of this description, where at least one pile-forming pile warp thread has a part which forms pile because it is interlaced with a third weft thread in each case, and has another part that is bound into a fabric in the form of dead pile warp thread, the quality of the resulting fabrics can likewise be improved.

Such fabrics are obtained according to the method described in FR-2.182.790.

These known fabrics do not show the complete pattern of the pile fabric on the back and the dead pile warp threads are not bound in in each warp thread portee distributed over both fabrics. Furthermore, the visible part of the pattern appears as a dashed line. If, with this method, the dead pile warp threads were to be bound in distributed over both fabrics, this would cause mixing contours (see above).

It is also an object of this invention, with such fabrics (where the pile-forming pile warp threads are interlaced with the third weft threads), to show the pattern clearly and completely on the back of the fabrics, as well as to bind in the dead pile warp threads in each warp thread portee distributed over both fabrics while preventing mixing contours.

This object is achieved in that, in each warp thread portee both at a transition from a pile-forming part to a bound-in part and at a transition from a bound-in part to a pile-forming part of a pile warp thread, said pile warp thread is interlaced with a third weft thread before it is bound in or starts forming pile, respectively, and in that the dead pile warp threads in each warp thread portee are bound in distributed over both fabrics.

As all pile sides are now interlaced with a weft thread on the back, the pattern of the fabric is clearly and completely visible on the back of the fabrics.

The dead pile warp threads are bound in in each warp thread portee distributed over both fabrics. Mixing contours are prevented because all pile sides are supported by adjacent (first) weft threads, so that they remain in the desired upright position after the face-to-face pile fabric has been cut through.

With the method described in the first paragraph of this description, the first weft thread can also be prevented from penetrating the second and third weft threads lying one above the other by a special way of binding the weft threads in by means of the binder warp threads.

The groups of weft threads are no longer provided in each case in one opening between the binder warp threads but are distributed in each case over two successive openings, so that a first weft thread or a second weft thread and a third weft thread, respectively, alternately extends between the binder warp threads. Moreover, the dead pile warp threads are bound in distributed over both fabrics in each warp thread portee in order to improve the quality of the fabric.

In this way, the first weft thread is in each case bound into an individual opening, separate from the adjacent second and third weft threads. The disadvantageous penetration of the second and third weft threads by the first weft threads is thus prevented. The abovementioned disadvantages which are caused by said penetration are thus overcome by this method according to the invention.

In the method described in the first paragraph of this description (and in which the dead pile warp threads are bound into one of the fabrics or divided over both fabrics), the penetration of adjacent second and third weft threads by the first weft threads can also be prevented by another special way of binding in the weft threads. In this case, a complete group of weft threads is also no longer always provided in the successive openings between the binder warp threads.

The binding in of the weft threads takes place in such a manner that in each case the second and third weft threads extend through said successive openings while the first weft threads extend in each case through an opening which is formed between, on the one hand, two binder warp threads and, on the other hand, the tension warp thread or through an opening which is formed between, on the one hand, the two binder warp threads and, on the other hand, at least one dead pile warp thread.

As the first weft threads in each case extend through individual openings and are consequently separated from the adjacent second and third weft threads, they can no longer penetrate said second and third weft threads. The above-mentioned disadvantages which resulted from said penetration are consequently eliminated.

According to a first possibility, the tension warp thread is bound in on the back of the fabric relative to the first weft threads, while the crossing of binder warp threads relative to the first weft threads is provided in each case on the pile side, so that the successive openings are formed between the crossing binder warp threads, on the one hand, and the tension warp thread, on the other.

According to a second possibility, the dead pile warp threads are bound in on the pile side of the fabric relative to the first weft threads, while the crossing of the binder warp threads relative to the first weft threads is provided in each case on the back, so that the successive openings are formed between the crossing binder warp threads, on the one hand, and at least one dead pile warp thread, on the other.

In the above-described methods, where the penetration of the second and third weft thread by the first weft thread is in each case prevented by a special way of binding in the weft threads using the binder warp threads, mixing contours are likewise prevented by first interlacing a pile warp thread which starts forming pile or finishes forming pile, respectively, with a third weft thread before it starts forming pile or is bound in, respectively.

The method as described in the first paragraph of this description can also be carried out in such a manner that the pile-forming pile warp threads are not visible on the back of the fabric (fabrics where pile is not passed through). This is achieved by interlacing the pile-forming pile warp threads in each case with the first weft threads (not located on the back) of successive groups of weft threads. In addition, the dead pile warp threads are bound in divided over both fabrics and in each warp thread portee so as to improve the quality of the fabrics.

As the third weft threads on the back of the resulting fabrics are not used for interlacing pile threads, such fabrics are suitable in particular for gluing onto surfaces, for example on a floor or walls. Since, in addition, the adhesive is only present between the weft threads on the back and the surface, the flexibility of the fabric pile threads is not affected, yet the adhesion of the fabric on the surface is excellent. The pile thread loops of the active pile do not come into contact with the surface and will therefore not be subject to wear. Moreover, this method requires less pile thread to achieve a certain effective pile height.

The methods according to this invention where the pile-forming pile warp threads are interlaced with third weft threads in order to produce fabrics where pile passes through, can be modified to a method where the pile-forming pile warp threads are interlaced with first weft threads to produce fabrics where pile does not pass through by allowing the interlacing of the pile warp threads to take place one pick earlier or one pick later. This requires only a minor modification of the control data for the device (such as, for example, a jacquard loom) for positioning the pile warp threads relative to the successive weft threads.

In a preferred method according to this invention, the first and third weft threads are provided such that they extend in planes lying one above the other, while the tension warp threads are in each case bound in such that they extend between said first and third weft threads.

As a result, the dead pile warp threads bound into the fabrics are protected on the back by these tension warp threads.

If the pile-forming pile warp threads are in each case interlaced with the weft thread (the first or third weft thread, depending on the method used according to this invention) running on the back of the tension warp thread, the pattern of the pile fabric is very accurate and clearly visible on the back of the pile fabrics.

A fabric (in particular, a carpet) which is weaved according to a three-pick weave tends to curl towards the back. This is caused by the fact that, on the one hand, the pile warp thread bound in on the back prevents the elongation or extension of the fabric on the back, while, on the other hand, the bound-in dead pile warp threads push the fabric apart on the pile side.

Moreover, the weft threads situated on the pile side of the dead pile warp threads may push these dead pile warp threads between successive weft threads against the tension warp threads, as a result of which dead pile warp treads are bound in in a wave-like manner and causing increased pile consumption.

An additional object of this invention is to eliminate these disadvantages. This object is achieved in that a second tension warp thread is provided for every warp thread system in each fabric. This second tension warp thread is bound in between the second and third weft threads so that only the second weft threads extend on the pile side of this second tension warp thread.

The first tension warp thread extends between the first and third weft threads of every warp thread system.

As a result of this second tension warp thread, the fabric can not extend on the pile side and curling is prevented. In addition, the weft threads running on the pile side press the dead pile warp threads against the first tension warp threads. The dead pile warp threads remain extended and pile consumption for binding in remains at a minimum.

When using two tension warp threads in every warp thread system, the warp threads of a warp thread system can be arranged next to one another in the following order: the first tension warp thread, the two binder warp threads, the second tension warp thread, the pile warp threads. The pile warp threads are thus in each case situated between two tension warp threads (the second tension warp thread of a warp thread system and the first tension warp thread of a subsequent warp thread system). The pile sides are consequently out of range of the binder warp threads, so that these binder warp threads cannot affect the orientation of the pile sides. Thus the pile sides assume the desired upright position and form straighter lines in the warp direction on the pile surface. This results in the pile sides not mixing with pile sides of an adjacent row of pile loops.

Furthermore, an additional tension warp thread may serve as a guide for the weft insertion means so that dead pile warp threads do not have to carry a weft insertion means which could result in them being damaged or breaking as a consequence of their contact with a weft insertion means.

The addition of a further tension warp thread in each fabric, as described above, can also be achieved using a method where the weft threads are bound in in a different manner than described above. By allowing both tension warp threads to run in such a manner that they are separated by the single weft threads, they extend above one another, thereby preventing curling of the pile fabric. By ensuring that a tension warp thread extends in each case on either side of the pile warp threads, straighter pile rows are achieved. Both measures can be applied separately or in combination.

With the method for manufacturing a face-to-face pile fabric where pile does not pass through, mixing contours are prevented by interlacing a pile warp thread which starts forming pile or finishes forming pile, respectively, with a first weft thread before it starts forming pile or is bound in, respectively.

By binding in the dead pile warp threads in such a manner that they extend between the second and third weft threads and extend on the pile side of the fabric relative to the first weft threads, the bound-in dead pile warp threads do not show through on the back of the pile fabrics, resulting in an identical appearance of the back of both pile fabrics. (After all, pile warp threads that are bound into the top fabric differ in color from the pile warp threads that are bound into the bottom fabric).

It is important that, in the above-described methods according to this invention, double pile warp threads do not occur.

Double (married) pile warp threads occur when a pile change is effected (when a first pile warp thread which formed pile from a certain pick onwards is bound in and a second pile warp thread which was bound in starts forming pile from the same pick onwards) in the face-to-face fabric, between a first pile warp thread which is to be bound into one fabric after the pile change and a second pile warp thread which was bound into the other fabric before the pile change.

The marriage of these pile warp threads between top fabric and bottom fabric results in so-called mixing colors (a pile side in one color area extends into another color field) causing poor delineation on the pile surface between adjacent color fields.

This is prevented by omitting a pile loop, or in other words by either binding the first pile warp thread into the pile fabric two picks earlier than the fixed pick or the second pile warp thread starting to form pile two picks later than the fixed pick.

The pile warp thread whose pile loop is omitted is set so that the omission takes place in the direction where there is more than one pile loop.

The method according to this invention can be implemented to great effect, using a triple weft insertion mechanism with which, alternately, a second and third weft thread are provided in the bottom fabric and a first weft thread in the top fabric, or a second and third weft thread in the top fabric and a first weft thread in the bottom fabric, respectively.

In a particularly preferred method according to this invention, at least one weft thread of the two weft threads of each group with which no pile warp thread is interlaced, is chosen to be thinner than the other weft threads of that group.

The pile-forming pile warp threads are thus interlaced in each case with a relatively thick weft thread while one or both of the other weft threads are relatively thin.

In the case of a pile fabric where pile passes through, this results in the pattern becoming visible even more clearly on the back, and the color of the bound-in dead pile warp threads not showing through on the back. Thus, both pile fabrics have an identical back which clearly shows the pattern.

An additional advantage thereof is the fact that the sides of the pile loops are pushed apart to a lesser degree if a relatively thin weft thread extends between these sides. This results in sides which are more upright which again serves to produce a clear and straight delineation of the pile fabric pattern.

The characteristics of the methods according to this invention are explained in the following description of a number of non-restricting examples of face-to-face pile fabrics manufactured in accordance with this method.

In this description, reference is made to the attached figures, in which:

BRIEF DESCRIPTION OF THE DRAWINGS

FIG. 1 shows a cross section of a face-to-face pile fabric where pile passes through, manufactured according to a first variant method according to this invention;

FIGS. 2 and 3 show a cross section of a face-to-face pile fabric where pile passes through, manufactured according to a second variant method according to this invention;

FIG. 4 shows the mutual position of the weft threads in a fabric of FIG. 2 or 3;

FIGS. 5 to 7 inclusive show the mutual position of the weft threads in a fabric, manufactured according to the second variant method, where weft threads of different thickness are provided;

FIGS. 8 and 9 show a cross section of a face-to-face pile fabric where pile passes through, manufactured according to a third variant method according to this invention, where one tension warp thread is provided for every warp thread system (FIG. 8) or two tension warp threads are provided for every warp thread system (FIG. 9), respectively;

FIGS. 10 and 12 show a cross section of a face-to-face pile fabric where pile passes through, manufactured according to a fourth variant method according to this invention, where one tension warp thread is provided for every warp thread system (FIG. 10) or two tension warp threads are provided for every warp thread system (FIG. 12), respectively;

FIGS. 11 and 13 show a cross section of a face-to-face pile fabric where pile passes through, manufactured according to a fifth variant method according to this invention, where one tension warp thread is provided for every warp thread system (FIG. 11) or two tension warp threads are provided for every warp thread system (FIG. 13), respectively;

FIGS. 23 and 24 show a cross section of a face-to-face pile fabric where pile does not pass through, manufactured according to a sixth variant method according to this invention;

FIG. 25 shows the mutual positions of the weft threads in a fabric of FIG. 23 or 24;

FIGS. 26 to 28 inclusive show the mutual positions of the weft threads in a fabric manufactured according to the sixth variant method, where weft threads having different thicknesses are provided.

DETAILED DESCRIPTION OF THE PREFERRED EMBODIMENTS

Figure 13:
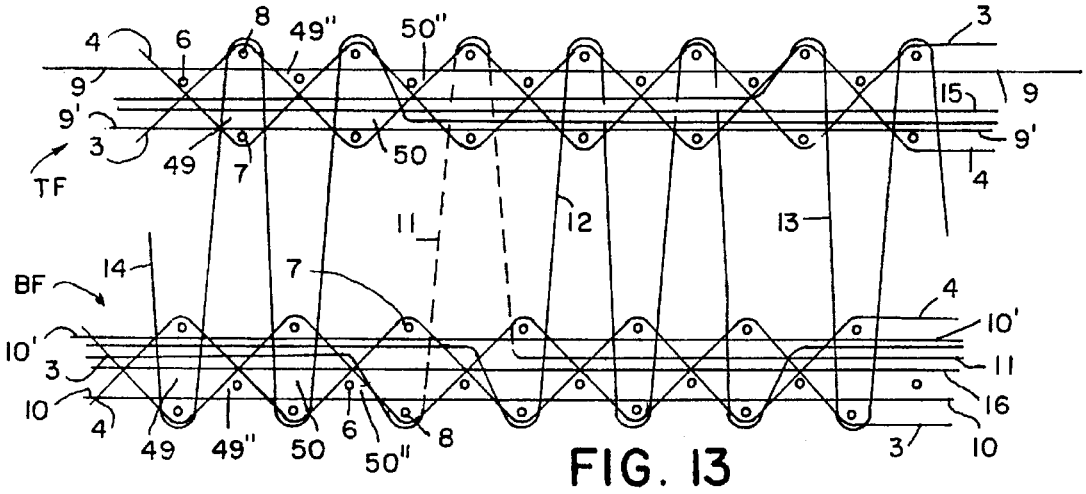

According to all variant methods of this invention, a face-to-face pile fabric is manufactured by forming a top fabric (TF) and a bottom fabric (BF). Both fabrics (TF, BF) are formed by providing for each fabric in each case successive groups of three weft threads (6, 7, 8), so that, in every group, a first weft thread (6) extends next to a second (7) and a third weft thread (8), which are located one above the other, and by providing, for each fabric (TF, BF), adjacent warp thread systems having two binder warp threads (3, 4), one or more tension warp threads (9, 10; 9', 10') and one or more pile warp threads (11–16).

These binder warp threads (3, 4) cross each other a number of times so as to provide successive openings (49–55; 49, 49', 50, 50'; 49, 49", 50, 50" . . . ; 49, 49'", 50, 50'" . . . ) between their points of intersection, through which extend in each case one or more weft threads (6, 7, 8). In this manner, the weft threads (6, 7, 8) are bound into the respective fabrics (TF, BF). The tension warp threads (9, 10; 9', 10') are bound into the respective fabrics (TF, BF) in each of the warp thread systems. The pile-forming pile warp threads (11–14) are interlaced with a weft thread (6, 8) alternately in the top fabric (TF) and in the bottom fabric (BF) in accordance with a three-pick weave.

A dead pile warp thread (11–16) is bound into one of the fabrics (TF, BF).

A pile warp thread (11–14) may have a part which forms pile and another part which may be bound in as dead pile warp thread.

Figure 22:
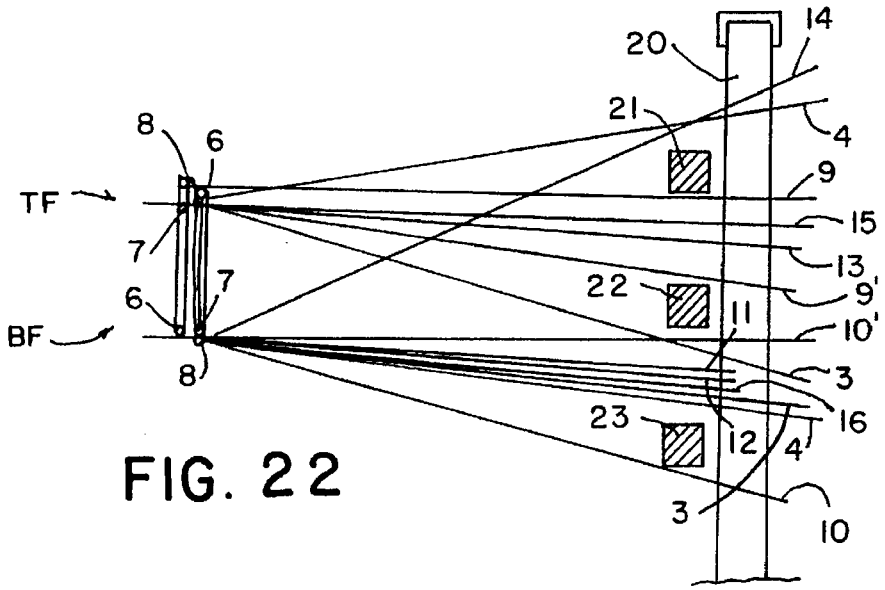
FIG. 22 shows a diagrammatic representation of the positions of the tension warp threads, binder warp threads and pile warp threads relative to the three weft insertion means of a triple weft insertion mechanism during weaving according to the invention of a face-to-face pile fabric having two tension warp threads for each fabric, on a face-to-face weaving loom.

The face-to-face pile fabric is manufactured on a face-to-face weaving loom provided with a triple weft insertion means (21, 22, 23, in FIG. 22), by means of which in each case three weft threads (6, 7, 8) are inserted simultaneously.

In a first operating cycle, a second (7) and a third weft thread (8) are inserted into the top fabric (TF) and a first weft thread (6) is inserted into the bottom fabric (BF).

In a second (subsequent) operating cycle, a first weft thread (6) is inserted into the top fabric (TF) and a second (7) and third weft thread (8) are inserted into the bottom fabric (BF).

By inserting six weft threads (6, 7, 8) in two working cycles of the weaving loom, very efficient weaving is achieved.

In accordance with a first variant method (see FIG. 1) according to this invention, a face-to-face carpet is manufactured, in which case the first weft threads (6) are provided in a plane on the back relative to the two planes above one another, through which the second (7) and third weft threads (8), respectively, extend.

The binder warp threads (3, 4) cross a number of times and form successive openings (49–55) through which extend in each case a second (7) and a third weft thread (8), one above the other, followed by a first weft thread (6).

In each fabric (TF, BF), in every warp thread system, a first tension warp thread (9, 10) is bound in which extends between the first weft threads (6) and the third weft threads (8).

Furthermore, in each fabric (TF, BF), in every warp thread system, a second tension warp thread (9', 10') is bound in which extends between the second (7) and third weft threads (8).

The dead pile warp threads (11'16) are bound in, divided over both fabrics (TF, BF), and extend between the second (7) and third weft threads (8). The pile-forming pile warp threads (11–13) are in each case interlaced with the first weft threads (6). After the face-to-face fabric has been cut through diagrammatic representation of cutting means in FIG. 1), the pile sides are supported by the second (7) and third weft threads (8) which extend next to one another. In this manner, an upright pile is produced and mixing contours are prevented.

The first tension warp thread (9, 10) protects the dead pile warp threads (11–16) on the back of the carpet.

Since only the first weft threads (6), on which pile is formed, extend on the back of the first tension warp thread (9, 10), the pattern is very clearly visible on the back of the carpet. The dead pile warp threads can be prevented from showing through on the back of the carpet by means of the first tension warp threads (9, 10).

The pattern is represented in full on the back of the carpet because a pile warp thread (12, 13) is interlaced with a first weft thread (6) at the transition from a bound-in part to a pile-forming part, before it starts forming pile, and because a pile warp thread (11, 12) is interlaced with a first weft thread (6) at the transition from a pile-forming part to a bound-in part, before it is bound in.

According to a second variant method (see FIGS. 2 and 3) according to this invention, a face-to-face carpet is manufactured, in which case the first weft threads (6) are provided in a plane situated between the two planes lying one above the other in which the second (7) and third weft threads (8), respectively, extend. In each case a first weft thread (6) followed by the second (7) and third weft threads (8) lying one above the other are provided through the openings (49–55) between the binder warp threads (3, 4) which cross a number of times. The dead pile warp threads (11–16) and the first tension warp threads (9, 10) are bound in in the same manner as with the first variant method, and thus result in the same advantages. The pile-forming pile warp threads (11–14) are in each case interlaced with third weft threads (8) situated on the back. The pile warp threads (11, 12, 13), a bound-in part of which changes to a pile-forming part, and the pile warp threads (11, 12, 14), a pile-forming part of which changes to a bound-in part, are interlaced first with a third weft thread (8) before they start forming pile or are bound in, respectively.

In this manner, mixing contours are prevented and the pattern is clearly and completely visible on the back of the carpet.

In accordance with a third variant method (see FIGS. 8 and 9) according to this invention, a face-to-face carpet is manufactured, in which case the weft threads (6, 7, 8) are in the same positions as with the second variant method. Likewise, the dead pile warp threads (11–16) and the first tension warp thread (9, 10) are bound into the fabrics (TF, BF) in the same manner as with the second variant method.

The pile-forming pile warp threads (11–14) also form pile along the third weft threads (8) situated on the back. At the start and at the finish of the pile formation, a pile warp thread (11–14) is first interlaced with a third weft thread (8) before it starts forming pile or is bound in, respectively.

The difference with the second variant method is the fact that the first weft thread (6) is enclosed in each case in a separate opening (49', 50' . . . ) by the binder warp threads (3, 4).

In every warp thread system there is a first binder warp thread (3) which successively interlaces the first (6) and the third weft threads (8) with the first tension warp thread (9, 10) and there is a second binder warp thread (4) which in each case interlaces the second weft thread (7) between the pile sides so that it is separated from the first weft thread (6).

In this manner, crossings of the binder warp threads (3, 4) are achieved on both sides of the first weft threads (6).

The binder warp threads (3, 4) thus form successive openings (49, 49', 50, 50', . . . ) through which alternately a first weft thread (6) or a second (7) and third weft thread (8), respectively, extend.

The first weft thread (6) thus extends in each case through a separate opening (49', 50', . . . ) which is located between two openings (49, 50; 58, 51), through which in each case the adjacent second (7) and third weft threads (8) extend.

In this way, the first weft threads (6) can no longer penetrate the adjacent second (7) and third weft threads (8), as a result of which a drawn pile is prevented (and thus mixing contours as well).

FIG. 9 differs from FIG. 8 in that a second tension warp thread (9', 10') was added to every warp thread system. The abovementioned advantages resulting from the use of two tension warp threads (9, 10), (9', 10') in every warp thread system are therefore also obtained with this variant method.

A fourth variant method (see FIGS. 10 and 12) according to this invention differs from the third variant method in that the weft threads (6, 7, 8) are bound in by the binder warp threads (3, 4) in a different manner.

The binding in of the weft threads takes place in such a manner that in each case the second (7) and third weft threads (8) extend through successive openings (49–55) between the binder warp threads (3, 4), while the first weft threads (6) in each case extend through an opening (49", 50") which is formed between, on the one hand, two binder warp threads (3, 4) and, on the other hand, the tension warp thread (9, 10). Because the first weft threads in each case extend through a separate opening and are consequently separated from the adjacent second and third weft threads, they can no longer penetrate the second and third weft threads. The disadvantages indicated above which resulted from said penetration are thus eliminated.

The face-to-face pile fabric according to FIG. 12 differs from that according to FIG. 10 in that a second tension warp thread (9', 10') was added to every warp thread system in each fabric (TF, BF), which results in the abovementioned advantages.

The tension warp thread (9, 10) is bound in on the back of the fabric relative to the first weft threads (6), while the crossing of binder warp threads (3, 4) relative to the first weft threads (6) is in each case provided on the pile side, so that the openings (49", 50", . . . ) are formed between, on the one hand, the crossing binder warp threads (3, 4) and, on the other hand, the tension warp thread (9, 10).

A fifth variant method according to this invention (see FIGS. 11 and 13) differs from the third and fourth variant method in that the weft threads (6, 7, 8) are bound in by the binder warp threads (3, 4) in yet another manner.

The binding in of the weft threads (6, 7, 8) takes place such that in each case the second (7) and third weft threads (8) extend through successive openings (49–55) between the binder warp threads (3, 4), while the first weft threads (6) in each case extend through an opening (49'", 50'", . . . ) which is formed between, on the one hand, the two binder warp threads (3, 4) and, on the other hand, at least one dead pile warp thread (11–16).

In this case, the first weft threads (6) in each case extend through separate openings (49'", 50'", . . . ) as well and are consequently separated from the adjacent second (7) and third weft threads (8) which extend through the adjacent openings (49–55). These first weft threads (6) can therefore no longer penetrate said adjacent second (7) and third weft threads (8) as a result of which a drawn pile is prevented (and thus mixing contours as well).

The face-to-face pile fabric according to FIG. 13 differs from that of FIG. 11 in that a second tension warp thread (9', 10') was added to every warp thread system in each fabric (TF, BF) which results in the abovementioned advantages.

The dead pile warp threads (11–16) are bound in on the pile side of the fabric (TF, BF) relative to the first weft threads (6), while the crossing of the binder warp threads (3, 4) relative to the first weft threads (6) is in each case provided on the back, so that the openings (49'", 50'", . . . ) are formed between, on the one hand, the crossing binder warp threads (3, 4 ) and, on the other hand, at least one dead pile warp thread (11–16).

The dead pile warp threads (11–16) are bound in on the pile side of the fabric (BF, TF) relative to the first weft threads (6) in order to prevent their color showing through on the back of the fabric.

The tension warp thread (9, 10) runs on the back of the fabric (BF, TF) relative to the first weft threads (6) and the pile-forming pile warp threads (11–14) are interlaced with the third weft threads (8). The resulting fabrics are pile fabrics where the pile passes through.

Figure 14:
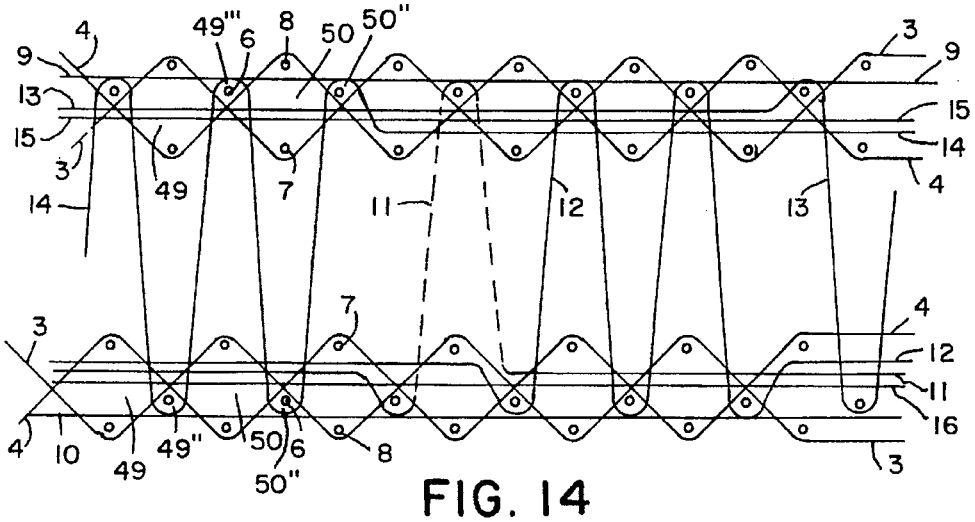
FIGS. 14 and 15 show a cross section of a face-to-face pile fabric where pile does not pass through, having one tension warp thread for every warp thread system, manufactured according to the fourth (FIG. 14) or fifth (FIG. 15) variant method, respectively, according to this invention.
Figure 15:
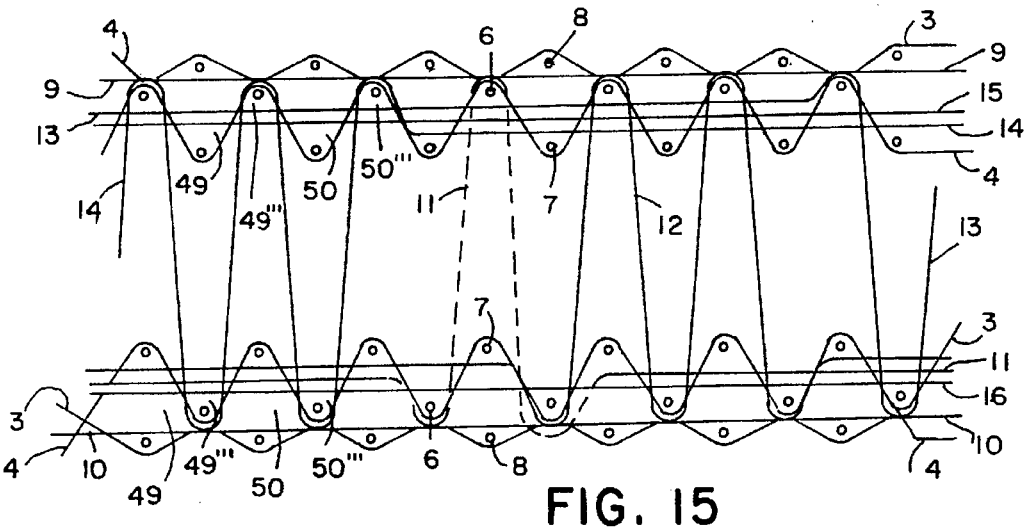

In FIGS. 14 and 15 the pile-forming pile warp threads (11–14) are interlaced with the first weft threads (6).

In FIG. 14, the first weft threads (6) are bound in according to the fourth variant method according to this invention.

Figure 16:
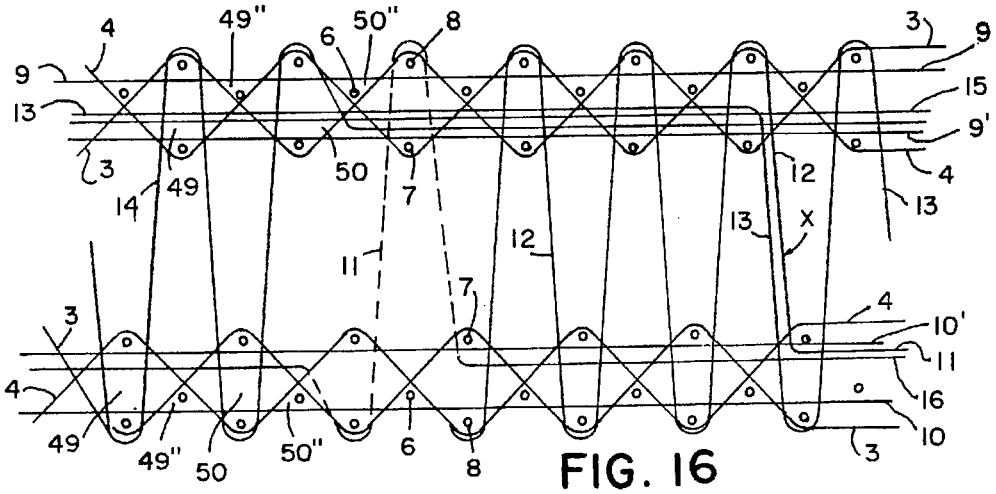
FIG. 16 shows a cross section of the face-to-face pile fabric according to FIG. 12 before the correction of the pile change.

In FIG. 16, the first weft threads (6) are interlaced according to the fifth variant method according to this invention.

When a pile-forming pile warp thread (12) is bound in from a certain pick onwards in one fabric, for example the bottom fabric (BF), and when a bound-in pile warp thread (13) starts forming pile from the same pick onwards, both pile warp threads (12, 13) marry at that location (X) between the top fabric (TF) and the bottom fabric (BF). This is referred to as double pile warp threads (see FIGS. 16 and 17).

These double pile warp threads (12, 13) cause mixing contours. Eliminating the pile loop prevents the two pile warp threads (12, 13) marrying. In essence, the pile warp thread (12) which has to finish forming pile is bound into the bottom fabric (BF) two picks earlier or the pile warp thread (13) which has to start forming pile starts forming pile two picks later.

If the binding-in data necessary to implement the methods according to this invention are stored in a data file of a computer, the double pile warp threads can be eliminated in a quick and relatively simple manner by going through this data file containing software and finding the locations where a pile change, as described above, takes place and omit a loop knop at those locations.

This omission takes place in the forward or backward direction, in the direction where there is more than one pile knop.

After correction of the pile change in the weave according to FIG. 16, a weave is achieved as represented in FIG. 12. With this weave, the pile warp thread (12) is bound into the bottom fabric (BF) two picks earlier so that one pile loop of this pile warp thread (12) is eliminated.

Figure 17:
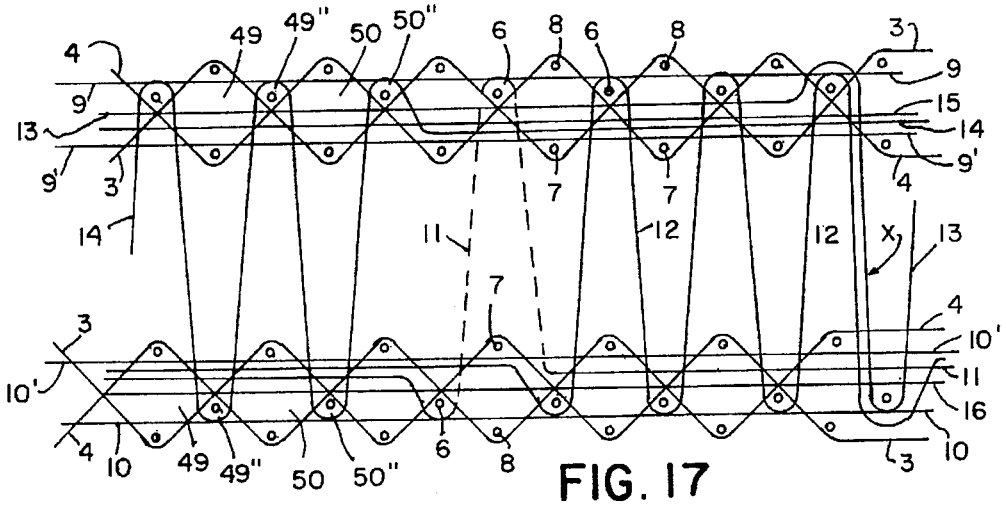
FIG. 17 shows a cross section of the face-to-face pile fabric according to FIG. 14, having an additional tension warp thread for every warp thread system, and before the correction of the pile change.

After correction of the pile change in a weave according to FIG. 17, a weave is achieved as represented in FIG. 14. In this case as well, the pile warp thread (12) is bound into the bottom fabric (BF) two picks earlier.

Figure 18:
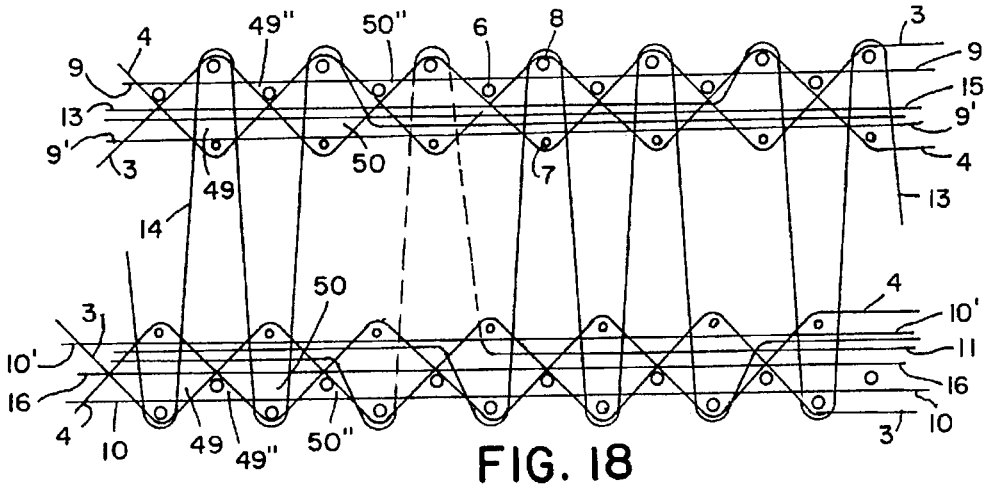
FIG. 18 shows a cross section of the face-to-face pile fabric according to FIG. 12, having in each case one relatively thin second weft thread on the pile side of the fabrics.
Figure 19:
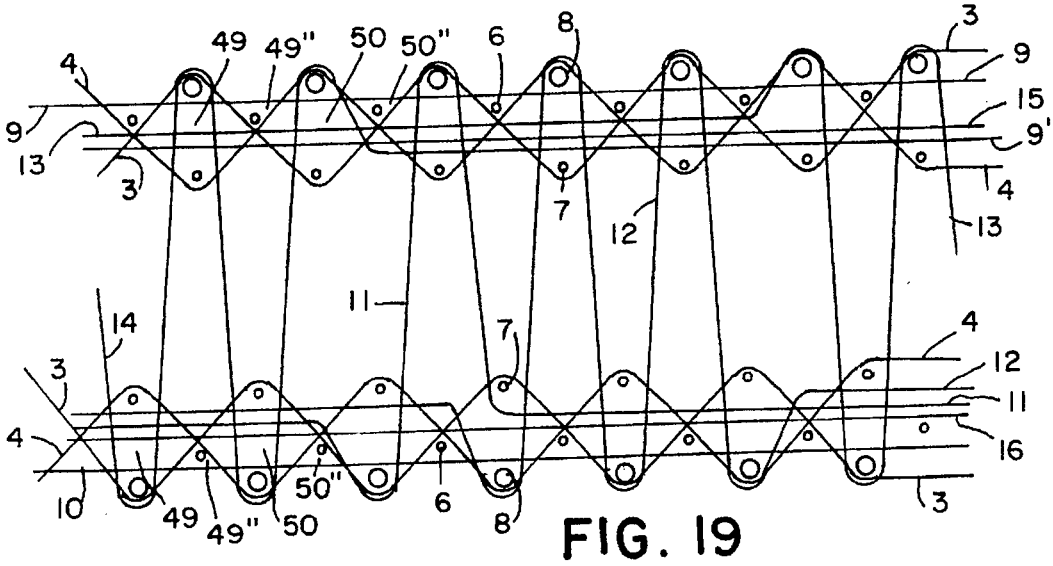
FIG. 19 shows a cross section of the face-to-face pile fabric according to FIG. 18, having in each case one relatively thin first and second weft thread and a relatively thick third weft thread on the back of the fabrics.

FIG. 18 shows a cross section of a face-to-face pile fabric where pile passes through and having in each case an additional tension warp thread (9', 10') in the top fabric (TF) and in the bottom fabric (BF). This fabric is manufactured according to the fourth variant method according to this invention. However, the following applies to all variant methods according to this invention where pile is formed on the third weft threads (8).

According to this method (FIG. 18), the second weft threads (7) are chosen to be thinner than the other weft threads (6), (8). This results in the sides of the pile loops being pushed apart to a lesser degree. It is also possible to choose the second weft threads (7) and the first weft threads (6) to be thinner than the third weft threads (8). In addition to the aforementioned advantage, this also has the advantage that the fabric back becomes less thick, as a result of which the part of the pile knop which is located in the back is shortened leading to a saving in pile material.

The relatively thick-weft on the back ensures a clear pattern on the back and prevents the color of the bound-in dead pile warp threads from showing through on the back. Thus the backs of the bottom fabric (BF) and of the top fabric (TF) have an identical pattern: the design pattern.

Figure 20:
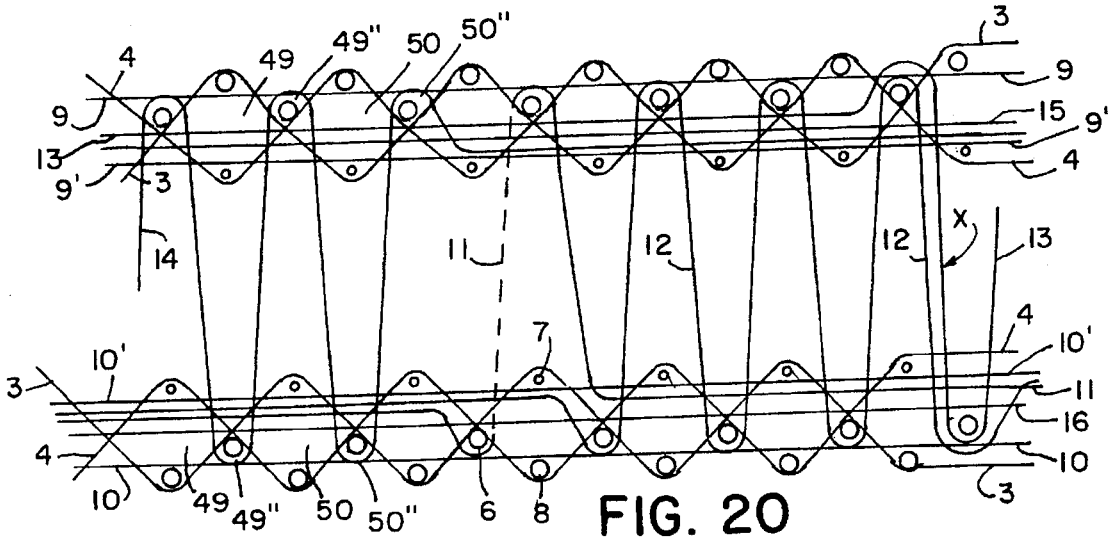
FIG. 20 shows a cross section of the face-to-face pile fabric according to FIG. 17, having in each case one relatively thin second weft thread and a relatively thick first and third weft thread.
Figure 21:
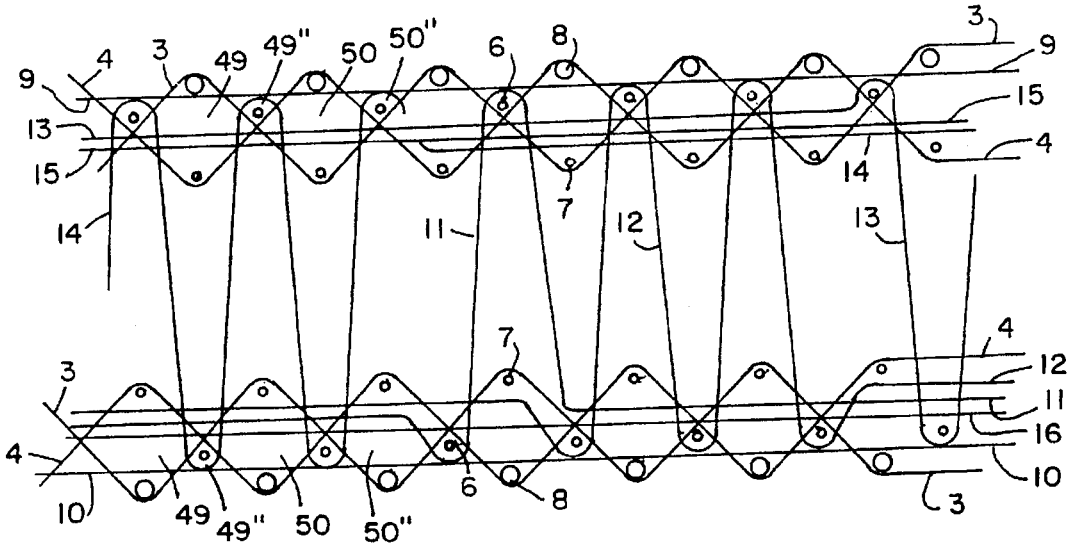
FIG. 21 shows a cross section of the face-to-face pile fabric according to FIG. 14, having in each case one relatively thin first and second weft thread and a relatively thick third weft thread on the back of the fabrics.

This method using relatively thin weft threads (7), and (6), (7), respectively, can also be used with face-to-face pile fabrics where pile does not pass through (see FIGS. 20 and 21).

The use of relatively thin weft threads results in similar advantages with the other variant methods according to this invention.

FIGS. 4 to 7 inclusive illustrate several cases where relatively thin weft threads (6, 7, 8) are used, in which the weft threads (6, 7, 8) and a pile loop are shown of a fabric which has been manufactured according to the first variant method according to the invention.

For every pile warp thread (11–16), the desired positions relative to the successive weft threads (6, 7, 8) are stored in the form of a set of control data. This set is incorporated, for example, in a card design which is processed to form a data file or to control a jacquard device. During weaving, this jacquard device can position the pile warp threads in accordance with the input control data.

In the method according to this invention, the same set of control data can be used both for manufacturing a face-to-face pile fabric where pile passes through and for manufacturing a face-to-face pile fabric where pile does not pass through, as the pile-formation only has to be moved one pick in order to obtain either one or the other face-to-face pile fabric.

When manufacturing a face-to-face pile fabric (TF), (BF) according to the methods according to this invention by means of a face-to-face weaving loom having a triple weft insertion mechanism.(see FIG. 22), the binder warp threads (3, 4), the tension warp threads (9, 10), (9', 10') and the pile warp threads (11–16) are taken to a level prior to every pick (or shot) relative to the respective weft insertion heights of the three weft insertion means (21, 22, 23) of a triple weft insertion mechanism such that these threads (3, 4, 9, 9', 10, 10', 11–16), after the insertion of the weft threads (6, 7, 8), extend in the top fabric (TF) and the bottom fabric (BF), in the position required according to the desired weave relative to the weft threads (6, 7, 8). The warp threads (3, 4, 9, 9', 10, 10', 11–16) extend through the reed (20). After the weft threads (6, 7, 8) have been inserted, they are pushed by the reed (20) to the edge of the face-to-face pile fabric (TF), (BF) already formed.

In this case, the binder warp threads (3, 4) and the tension warp threads (9, 10), (9', 10') are positioned, for example, by means of heald frames, while the pile warp threads (11–16) are positioned by means of a jacquard mechanism.

The triple weft insertion mechanism alternately inserts two weft threads (7, 8) into the top fabric (TF) and one weft thread (6) into the bottom fabric (BF), or two weft threads (7, 8) into the bottom fabric (BF) and one weft thread (6) into the top fabric (TF), respectively. The top weft insertion means (21) alternately inserts a weft thread (6) and a weft thread (8) into the top fabric (TF). The bottom weft insertion means (13) alternately inserts a weft thread (8) and a weft thread (6) into the bottom fabric (BF).

The center weft insertion means (22) alternately inserts a weft thread (7) into the bottom fabric (BF) and a weft thread (7) into the top fabric (TF).

In the method according to this invention, in which two tension warp threads (9, 10), (9', 10') are provided for each fabric (.TF), (BF), the tension warp threads (9', 10') serve as a guide for the weft insertion means (21, 22, 23). In the situation illustrated in FIG. 22, the tension warp thread (9) of the top fabric (TF), the tension warp thread (10') of the bottom fabric (BF) and the tension warp thread (10) of the bottom fabric (BF) form a guide for the top (21), centre (22) and bottom (23) weft insertion means, respectively. Thus, the dead pile warp threads (11–14) do not have to fulfil this guide function and they are prevented from being damaged or breaking.

Figure 23:
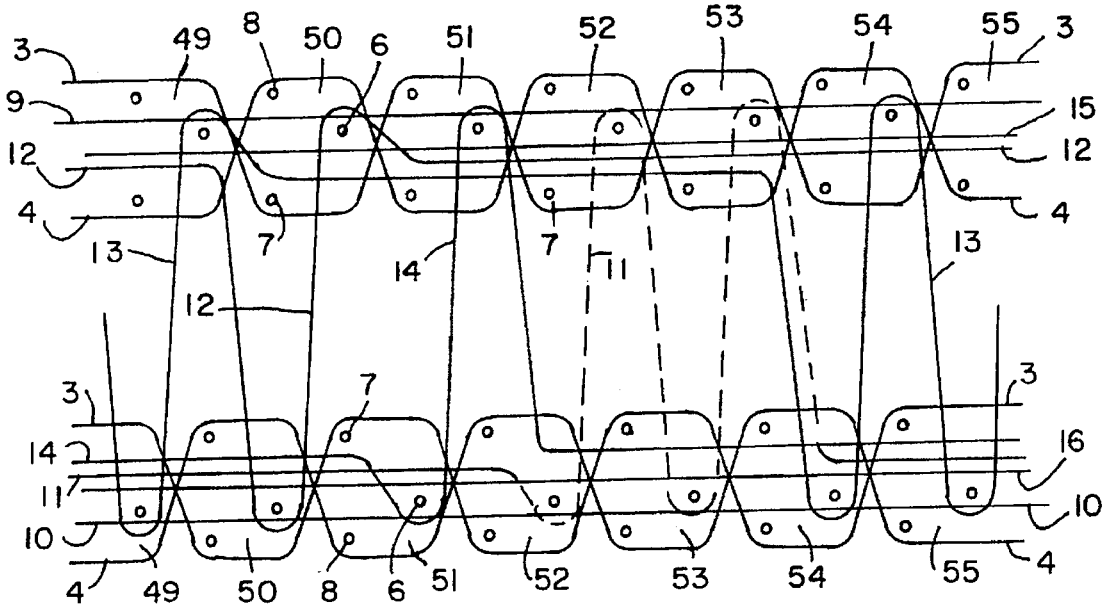

According to the sixth variant method (see FIGS. 23 and 24) according to this invention, fabrics are produced which only differ from the second variant method (FIGS. 2 and 3) in that the pile-forming pile warp threads (11–14) are in each case interlaced with the first weft threads (6).

In other words, by shifting the pile formation by one pick, fabrics where the pile does not pass through are produced.

FIGS. 25 to 28 inclusive illustrate the weft threads (6, 7, 8) and a pile loop of a fabric which was manufactured according to this sixth variant method, and where (FIG. 26–28) the second (7) and/or the third weft thread (8) are chosen to be thinner than the other weft thread or weft threads.

The use of relatively thin weft threads has the advantage that less pile thread material is required to achieve the same pile level and that the pile sides are pushed apart to a lesser degree.

We claim:

1. A method for manufacturing a face-to-face pile fabric, comprising the steps of:

forming a top fabric and a bottom fabric by providing successive groups of three weft threads for each fabric wherein each group has a first weft thread extending next to a second weft thread and a third weft thread, said second and third weft threads being located one above another;

providing adjacent warp thread systems having two binder warp threads for each fabric, said binder threads crossing a number of times for forming successive openings between points of intersections of the crossing binder threads;

extending each of the groups of weft threads through the successive openings;

binding at least one of plural tension warp threads into each fabric in each of the warp thread systems;

binding another part of said pile warp thread into a fabric to form a dead pile warp thread;

inserting two weft threads in one of the top and bottom fabrics and one weft thread in another of the top and bottom fabrics simultaneously;

interlacing in each of the warp thread systems at least one pile-forming pile warp thread with a weft thread in a three-pick weave, wherein the interlacing occurs alternately in the top fabric and in the bottom fabric;

cutting through all pile-forming pile warp threads between the fabrics;

extending the first weft threads of the successive groups in a first plane, the second weft threads in a second plane and the third weft threads in a third plane, respectively, wherein the first plane is on a back of the fabric relative to that of the second and third planes;

wherein the interlacing comprises interlacing each of the pile-forming pile warp threads with the first weft thread;

further comprising binding each of plural dead pile warp threads in each of plural warp thread portees for distributing the dead pile warp threads over the top fabric and the bottom fabric.

2. The method of claim 1, wherein at least one pile warp thread changes from said pile-forming part to a bound-in part by interlacing the at least one pile warp thread with the first weft thread prior to the bound-in part and/or at least one pile warp thread changes from a bound-in part to a pile forming part by interlacing the at least one pile warp thread with the first weft thread prior to the pile-forming part.

3. A method for manufacturing a face-to-face pile fabric, comprising:

forming a top fabric and a bottom fabric by providing successive groups of three weft threads for each fabric, such that, in every group, a first weft thread is followed by a second weft thread and a third weft thread, said second and third weft threads being located one above another on a pile side and on a back side of the fabrics, respectively;

providing for each fabric adjacent warp thread systems having two binder warp threads crossing a number of times for forming successive openings between their points of intersection;

extending each of the group of the weft threads through the openings;

binding at least one tension warp thread into each fabric in each of the warp thread systems;

providing in each of the warp thread systems at least one pile warp thread, interlacing one part of said pile warp thread with the third weft thread to form a pile in a three-pick weave, alternately in the top fabric (TF) and in the bottom fabric (BF), respectively, binding another part of said pile warp thread into a fabric to form a dead pile warp thread;

inserting two weft threads in one of the top and bottom fabrics and one weft thread in another of the top and bottom fabrics simultaneously;

cutting through the pile-forming parts of all pile warp threads between both the fabrics;

interlacing said pile warp thread with a third weft thread in a warp thread portee, at each of plural transition points from a pile-forming part to a bound-in part and from a bound-in part to a pile-forming part of a pile warp thread, respectively; and binding the dead pile warp threads in each of the warp thread portees for distributing the dead pile warp threads over the top fabric and the bottom fabric.

4. Method for manufacturing a face-to-face pile fabric, comprising the steps of:

forming a top fabric and a bottom fabric by providing successive groups of three weft threads for each fabric, so that, in every group, a first weft thread extends next to a second weft thread and a third weft thread, said second and third weft threads being located one above the other on a pile side and a back side of the fabric, respectively;

providing for each fabric adjacent warp thread systems having two binder warp threads crossing a number of times to form successive openings and enclosing the weft threads in the successive openings;

binding a tension warp thread into each fabric in each of the warp thread systems;

interlacing in a three-pick weave in each of the warp thread systems at least one pile-forming pile warp thread with a third weft thread, alternately in the top fabric and in the bottom fabric;

binding another part of said pile warp thread into a fabric to form a dead pile warp thread;

inserting two weft threads in one of the top and bottom fabrics and one weft thread in another of the top and bottom fabrics simultaneously;

cutting through all pile-forming pile warp threads between both fabrics;

extending alternately the first weft thread or the second and the third weft threads, respectively, through the successive openings between the binder warp threads; and binding each of plural dead pile warp threads in each of plural warp thread portees for distributing the dead pile warp threads over the top fabric and the bottom fabric.

5. The method of claim 4, further comprising interlacing the pile warp thread having a pile-forming part changing into a bound-in part with a third weft thread before being bound-in, and/or interlacing the pile warp thread having a bound-in part changing into a pile-forming part with a third weft thread before starting to form a pile.

6. A method for manufacturing a face-to-face pile fabric, in which forming a top fabric and a bottom fabric by providing successive groups of three weft threads for each fabric, so that, in every group, a first weft thread extends next to a second and a third weft thread, wherein said second and third weft threads are located one above the other on the pile side and on the back of the fabric, respectively, providing, for each fabric, adjacent warp thread systems having two binder warp threads which cross a number of times to form successive openings between their points of intersection, through which extends at least one weft thread;

binding a tension warp thread into each fabric in each of the warp thread systems;

interlacing in each of the warp thread systems at least one pile-forming pile warp thread, in a three-pick weave, with a weft thread alternately in the top fabric and in the bottom fabric;

binding dead pile warp threads into one of both fabrics, or over both fabrics;

binding another part of said pile warp thread into a fabric to form a dead pile warp thread;

inserting two weft threads in one of the top and bottom fabrics and one weft thread in another of the top and bottom fabrics simultaneously;

cutting through all pile-forming pile warp threads between both fabrics;

extending the second and the third weft threads through said successive openings, and extending the first weft threads through an opening formed between two binder warp threads and a tension warp thread, or through an opening formed between the two binder warp threads and at least one dead pile warp thread.

7. The method of claim 6, further comprising running the tension warp thread on the back side of the fabric relative to the first weft threads, and crossing the binder warp threads relative to the first weft threads provided in each case on the pile side, for forming the successive openings between the crossing binder warp threads and the tension warp thread.

8. The method of claim 6, wherein binding the dead pile warp threads comprises binding on the pile side of the fabric relative to the first weft threads, and crossing the binder warp threads relative to the first weft threads on the back side, for forming the successive openings between the crossing binder warp threads and at least one dead pile warp thread.

9. A method for manufacturing a face-to-face pile fabric, comprising the steps of:

forming a top fabric and a bottom fabric by providing successive groups of three weft threads for each fabric, so that, in every group, a first weft thread which is not located on the back of the fabrics is followed by a second and a third weft thread wherein the second and third weft threads are located one above the other on a pile side and on a back of the fabric, respectively;

providing, for each fabric, adjacent warp thread systems having two binder warp threads which cross a number of times so as to form successive openings between their points of intersection, through which extends a group of weft threads;

binding a tension warp thread into each fabric in each of the warp thread systems;

interlacing in each of the warp thread systems at least one pile-forming pile warp thread, in a three-pick weave, with a weft thread, alternately in the top fabric and in the bottom fabric;

binding another part of said pile warp thread into a fabric to form a dead pile warp thread;

inserting two weft threads in one of the top and bottom fabrics and one weft thread in another of the top and bottom fabrics simultaneously;

cutting through all pile-forming pile warp threads (11–14) between both fabrics (TF, BF);

binding dead pile warp threads in warp thread portee for distributing the dead pile warp threads over both fabrics; and interlacing the pile-forming pile warp threads with the first weft thread of successive groups.

10. The method of claim 9, wherein the first weft threads and the third weft threads extend in planes lying one above another, and wherein the tension warp threads extend between said first and said third weft threads.

11. The method of claim 9, wherein a second tension warp thread is bound-in in each warp thread system between the second and the third weft threads such that only the second weft threads extend on the pile side of the second tension warp threads.

12. The method of claim 9, wherein the tension warp threads extend in each warp thread system on either side of the pile warp threads.

13. The method of claim 12, wherein at least one of the tension warp threads of a warp thread system is used as support for a weft insertion means.

14. The method of claim 9, further comprising interlacing the pile warp thread whose pile-forming part changes into a bound-in part with the first weft thread before it is bound in, and/or interlacing the pile warp thread whose bound-in part changes into a pile-forming part with the first weft thread before it starts forming pile.

15. The method of claim 9, wherein the dead pile warp threads are bound in between the second and third weft threads and extend on the pile side of the fabric relative to the first weft threads.

16. The method of claim 9, further comprising preventing a marriage between the pile warp threads between the top fabric and the bottom fabric in order to effect a pile change—at a particular shot in the face-to-face fabric—between a first pile warp thread, which is to be bound into one fabric after the pile change, and a second pile warp thread which was bound into the fabric before the pile change, by either binding the first pile warp thread into the pile fabric two picks earlier than a fixed pick or by allowing the second pile warp thread to start forming pile two picks later than the fixed pick.

17. The method of claim 9, wherein alternately, a second and third weft thread are provided in the bottom fabric and a first weft thread in the top fabric, or a second and a third weft thread in the top fabric and a first weft thread in the bottom fabric, respectively, using a triple weft insertion means.

18. The method of claim 9, wherein the interlacing of the pile-forming pile warp threads with the weft threads in each fabric is effected one pick earlier or later than an fixed pick.

19. A method for manufacturing a face-to-face pile fabric, comprising the steps of:

forming a top fabric and a bottom fabric by allowing weft threads to interact with adjacent warp thread systems, which comprise two binder warp threads and a tension warp thread, so that the binder warp threads cross a number of times so as to form successive openings between their points of intersection, through which extends at least one weft thread and so that the tension warp thread is bound into the fabric;

interlacing pile-forming pile warp threads in a three-pick weave alternately in the top fabric and in the bottom fabric, binding a part of said pile warp thread into a fabric to form a dead pile warp thread;

and binding dead pile warp threads for distribution over top and bottom fabric;

cutting through the pile-forming pile warp threads between both fabrics;

binding in each warp thread system, a second tension warp thread in such a manner that both tension warp threads extend one above the other, separated by a weft thread and/or in that a tension warp thread extends on either side of the pile warp threads.

20. The method of claim 19, wherein at least one of the tension warp threads of a warp thread system serves as support for a weft insertion means.

21. The method of claim 19, wherein of the two weft threads for each group which are not interlaced with a pile warp thread at least one weft thread is thinner than the other weft thread of that group.

* * * * *